US012485334B2

(12) United States Patent
Yoo et al.

(10) Patent No.: US 12,485,334 B2
(45) Date of Patent: Dec. 2, 2025

(54) WEIGHT EXERCISE DEVICE AND METHOD

(71) Applicant: DRAX INC., Anyang-si (KR)

(72) Inventors: Seon Kyung Yoo, Seoul (KR); Jae Sang Park, Seongnam-si (KR)

(73) Assignee: DRAX INC., Anyang-si (KR)

( * ) Notice: Subject to any disclaimer, the term of this patent is extended or adjusted under 35 U.S.C. 154(b) by 289 days.

(21) Appl. No.: 18/007,382

(22) PCT Filed: Jul. 29, 2021

(86) PCT No.: PCT/KR2021/009897

§ 371 (c)(1),
(2) Date: Jan. 30, 2023

(87) PCT Pub. No.: WO2022/030881

PCT Pub. Date: Feb. 10, 2022

(65) Prior Publication Data

US 2023/0271077 A1 Aug. 31, 2023

(30) Foreign Application Priority Data

Aug. 5, 2020 (KR) ..... 10-2020-0098134
Nov. 24, 2020 (KR) ..... 10-2020-0159086

(51) Int. Cl.
*A63B 71/06* (2006.01)
*A63B 21/062* (2006.01)
*A63B 24/00* (2006.01)

(52) U.S. Cl.
CPC ..... *A63B 71/0622* (2013.01); *A63B 21/063* (2015.10); *A63B 24/0006* (2013.01);
(Continued)

(58) Field of Classification Search
None
See application file for complete search history.

(56) References Cited

U.S. PATENT DOCUMENTS 5,078,152 A * 1/1992 Bond ..... A63B 24/0003 600/587
5,993,356 A * 11/1999 Houston ..... A63B 21/0058 482/7

(Continued)

FOREIGN PATENT DOCUMENTS

AU 2014280966 A1 5/2016
CN 102755714 A 10/2012

(Continued)

OTHER PUBLICATIONS

Office Action dated Jan. 2, 2023 issued by the Korean Patent Office in Korean Application No. 10-2020-0159094.

(Continued)

*Primary Examiner* — Shila Jalalzadeh Abyaneh
(74) *Attorney, Agent, or Firm* — Sughrue Mion, PLLC

(57) ABSTRACT

Provided is a weight exercise device. The weight exercise device includes: an exercise body in which a motion is generated according to a weight exercise of a user; a sensor configured to detect the motion of the exercise body; a display configured to output a user interface screen; and a processor configured to control the display to display, on the user interface screen, a first indicator indicating an exercise state of the user corresponding to the detected motion and a second indicator indicating an exercise guide that is recommended when exercising using the exercise body, wherein the processor is further configured to control the display such that a position of the second indicator is adaptively changed based on the exercise state of the user.

9 Claims, 22 Drawing Sheets

(52) U.S. Cl.
CPC ..... *A63B 24/0062* (2013.01); *A63B 24/0075* (2013.01); *A63B 2071/0641* (2013.01); *A63B 2071/0647* (2013.01); *A63B 2220/13* (2013.01); *A63B 2220/805* (2013.01); *A63B 2230/605* (2013.01)

(56) References Cited

U.S. PATENT DOCUMENTS

| | | | | |
|---|---|---|---|---|
| 7,794,359 | B1 * | 9/2010 | Lannon | A63B 21/156 482/901 |
| 8,337,364 | B2 * | 12/2012 | Ishii | A63B 23/0405 482/901 |
| 10,926,128 | B2 | 2/2021 | Yoo et al. | |
| 2006/0264299 | A1 * | 11/2006 | Farinelli | A63B 24/0006 482/8 |
| 2011/0065549 | A1 | 3/2011 | Jung et al. | |
| 2012/0220429 | A1 | 8/2012 | Yoshida et al. | |
| 2013/0072353 | A1 * | 3/2013 | Alessandri | A63B 21/06 482/8 |
| 2014/0172136 | A1 | 6/2014 | Ura | |
| 2015/0302331 | A1 | 10/2015 | Randall | |
| 2016/0193499 | A1 | 7/2016 | Kim et al. | |
| 2020/0316434 | A1 * | 10/2020 | Bengtsson | A61B 5/6895 |
| 2021/0016150 | A1 | 1/2021 | Jeong et al. | |

FOREIGN PATENT DOCUMENTS

| | | | | | |
|---|---|---|---|---|---|
| CN | 105797306 | A | | 7/2016 | |
| EP | 2383021 | A1 | | 11/2011 | |
| JP | 2004-65382 | A | | 3/2004 | |
| JP | 2013103020 | A | * | 5/2013 | |
| JP | 2020-48827 | A | | 4/2020 | |
| KR | 20-0353290 | Y1 | | 6/2004 | |
| KR | 10-2011-0029799 | A | | 3/2011 | |
| KR | 10-2012-0014471 | A | | 2/2012 | |
| KR | 101432129 | B1 | * | 8/2014 | A63B 21/063 |
| KR | 101571362 | B1 | * | 11/2015 | A63B 21/062 |
| KR | 10-1616545 | B1 | | 4/2016 | |
| KR | 10-2016-0084703 | A | | 7/2016 | |
| KR | 10-2017-0135591 | A | | 12/2017 | |
| KR | 10-1871388 | B1 | | 6/2018 | |
| KR | 10-2018-0100753 | A | | 9/2018 | |
| KR | 10-1982168 | B1 | | 5/2019 | |
| KR | 102002290 | B1 | * | 7/2019 | A63B 24/0006 |
| KR | 10-2019-0099555 | A | | 8/2019 | |
| KR | 20190099555 | A | * | 8/2019 | A63B 21/0626 |
| KR | 10-2019724 | B1 | | 9/2019 | |
| KR | 10-2031243 | B1 | | 10/2019 | |
| KR | 10-2020-0022776 | A | | 3/2020 | |
| KR | 10-2088673 | B1 | | 3/2020 | |
| KR | 10-2020-0064558 | A | | 6/2020 | |
| WO | 2009/034309 | A1 | | 3/2009 | |
| WO | 2012/020859 | A1 | | 2/2012 | |
| WO | WO-2019016406 | A1 | * | 1/2019 | G09B 5/02 |

OTHER PUBLICATIONS

Office Action dated Sep. 29, 2022 issued by the Korean Patent Office in Korean Application No. 10-2020-0159084.

Office Action dated Sep. 29, 2022 issued by the Korean Patent Office in Korean Application No. 10-2020-0159086.

Office Action dated Sep. 29, 2022 issued by the Korean Patent Office in Korean Application No. 10-2020-0159087.

Office Action dated Sep. 8, 2022 issued by the Korean Patent Office in Korean Application No. 10-2020-0159094.

"Frequently Asked Questions for Social Distancing Configuration", BITLA Solutions Simplified, Jun. 24, 2020, Bitla Software Pvt. Ltd., Retrieved from: https:www.bitlasoft.com/blog/frequently-asked-questions-for-social-distancing-configuration/, pp. 1-8 (8 pages total).

International Search Report dated Nov. 5, 2021 in International Application No. PCT/KR2021/009897.

Written Opinion of the International Searching Authority dated Nov. 5, 2021 in International Application No. PCT/KR2021/009897.

Office Action issued Jul. 27, 2023 in Korean Application No. 10-2023-0082133.

Extended European Search Report issued Aug. 5, 2024 in Application No. 21852511.1.

Communication dated Aug. 2, 2024 issued by the State Intellectual Property Office of the P.R.China in application No. 202180056666.7.

* cited by examiner

WEIGHT EXERCISE DEVICE AND METHOD

This Application is a National Stage of International Application No. PCT/KR2021/009897 filed Jul. 29, 2021, claiming priority based on Korean Patent Application No. 10-2020-0098134 filed Aug. 5, 2020 and Korean Patent Application No. 10-2020-0159086 filed Nov. 24, 2020.

TECHNICAL FIELD

The present disclosure relates to a weight exercise device and method.

BACKGROUND ART

In accordance with the increased quality of life, the interest of people in health is increasing, and numerous people are using various forms of weight exercise equipment to improve their physical strength.

Weight exercise equipment is provided in various forms according to the body part or purpose of use, to increase muscle strength, and is configured to strengthen the upper body or the lower body with hands or feet. Various types of weight exercise equipment are used according to body parts for increasing muscle strength, including shoulder presses, bench presses, abdominal machines, butterfly machines, and arm curl machines.

Weight exercise equipment is installed such that a plurality of block-shaped weight members overlap, and may include a pin structure for selecting some of the plurality of weight members. A user may select the number or weight of weight members he or she wants to lift, by using the pin structure. The user may exercise by moving a selected weight through the exercise structure of the exercise equipment.

However, when exercising using weight exercise equipment, it is difficult to accurately check one's own exercise state, and also difficult to provide accurate motivation, such as exercise goals, and thus it was difficult to expect an improvement in exercise effect.

DESCRIPTION OF EMBODIMENTS

Technical Problem

The present disclosure provides a weight exercise device and method for efficiently guiding weight exercise of a user despite the irregular exercise patterns of a user.

The present disclosure also provides a weight exercise device and method for efficiently guiding various types of weight exercise of a user.

Solution to Problem

A weight exercise device according to an embodiment includes:

an exercise body in which a motion is generated according to a weight exercise of a user; a sensor configured to detect the motion of the exercise body; a display configured to output a user interface screen; and a processor configured to control the display to display, on the user interface screen, a first indicator indicating an exercise state of the user corresponding to the detected motion and a second indicator indicating an exercise guide that is recommended when exercising using the exercise body, wherein the processor is further configured to control the display such that a position of the second indicator is adaptively changed based on the exercise state of the user.

The position of the second indicator may be dependent on the exercise state of the user.

The processor may be further configured to control the display such that, when it is determined based on a result of detecting, that an exercise direction of the user is changed, the second indicator is displayed at a position where a direction of the first indicator is changed.

The processor may be further configured to control the display such that the first indicator and the second indicator reciprocate along a reference line on the user interface screen, in a first direction and a second direction opposite to the first direction.

The display may display the reference line in a curved form.

The processor may be further configured to control the display such that a velocity of the second indicator in the first direction is different from a velocity of the second indicator in the second direction.

The processor may be further configured to control the display such that, in order that the user exercises at different velocities when doing a concentric contraction exercise and when doing an eccentric contraction exercise, the velocity of the second indicator is varied according to a direction of the second indicator.

The exercise body may include a plurality of weight members, a frame structure supporting the plurality of weight members to be movable in the direction of gravity, and a pin structure configured to select at least some of the plurality of weight members, and the sensor may be configured to detect information related to at least one of a position of the weight member selected by the pin structure, and a movement velocity and a movement direction of the weight member.

The sensor may be installed on the frame structure, and may be further configured to irradiate a laser beam to the pin structure, and receive a reflected laser beam and measure a distance to the pin structure.

A weight exercise device according to an embodiment includes: an exercise body in which a motion is generated according to a weight exercise of a user; a sensor configured to detect the motion of the exercise body; a display configured to output a user interface screen; and a processor configured to control the display such that a first indicator and a second indicator reciprocate along a reference line on the user interface screen, in a first direction and a second direction opposite to the first direction, wherein the first indicator indicates an exercise state of the user corresponding to the detected motion and the second indicator indicates an exercise guide that is recommended when exercising using the exercise body, wherein the processor is further configured to control the display such that a velocity of the second indicator in the first direction is different from a velocity of the second indicator in the second direction.

A weight exercise method according to an embodiment includes: outputting a user interface screen on a display; detecting a motion of an exercise body; and displaying, on the user interface screen, a first indicator indicating an exercise state of a user corresponding to the detected motion and a second indicator indicating an exercise guide that is recommended when exercising using the exercise body, wherein the displaying includes adaptively changing and displaying a position of the second indicator, based on the exercise state of the user.

The displaying may include displaying the position of the second indicator by changing the position of the second indicator to be dependent on the exercise state of the user.

The displaying may include displaying, when a direction of the first indicator is changed, the second indicator at a position where the direction of the first indicator is changed.

The displaying may include displaying such that the first indicator and the second indicator reciprocate in a first direction and a second direction opposite to the first direction, along a reference line on the user interface screen.

The displaying may include displaying such that a velocity of the second indicator in the first direction different from a velocity of the second indicator in the second direction.

In addition to the aforesaid details, other aspects, features, and advantages will be clarified from the following drawings, claims, and detailed description.

These general and specific embodiments may be implemented by using a system, a method, a computer program, or a combination of the system, the method, and the computer program.

Advantageous Effects of Disclosure

According to a weight exercise device and method of an embodiment of the present disclosure, despite the irregular exercise patterns of a user, the weight exercise of the user may be guided efficiently.

According to the weight exercise device and method of an embodiment of the present disclosure, various types of weight exercise of a user may be guided efficiently.

Also, the weight exercise device and method of an embodiment of the present disclosure enable tracking of the exercise of a user and have a simple structure, which minimizes additional costs.

MODE OF DISCLOSURE

Figure 1:
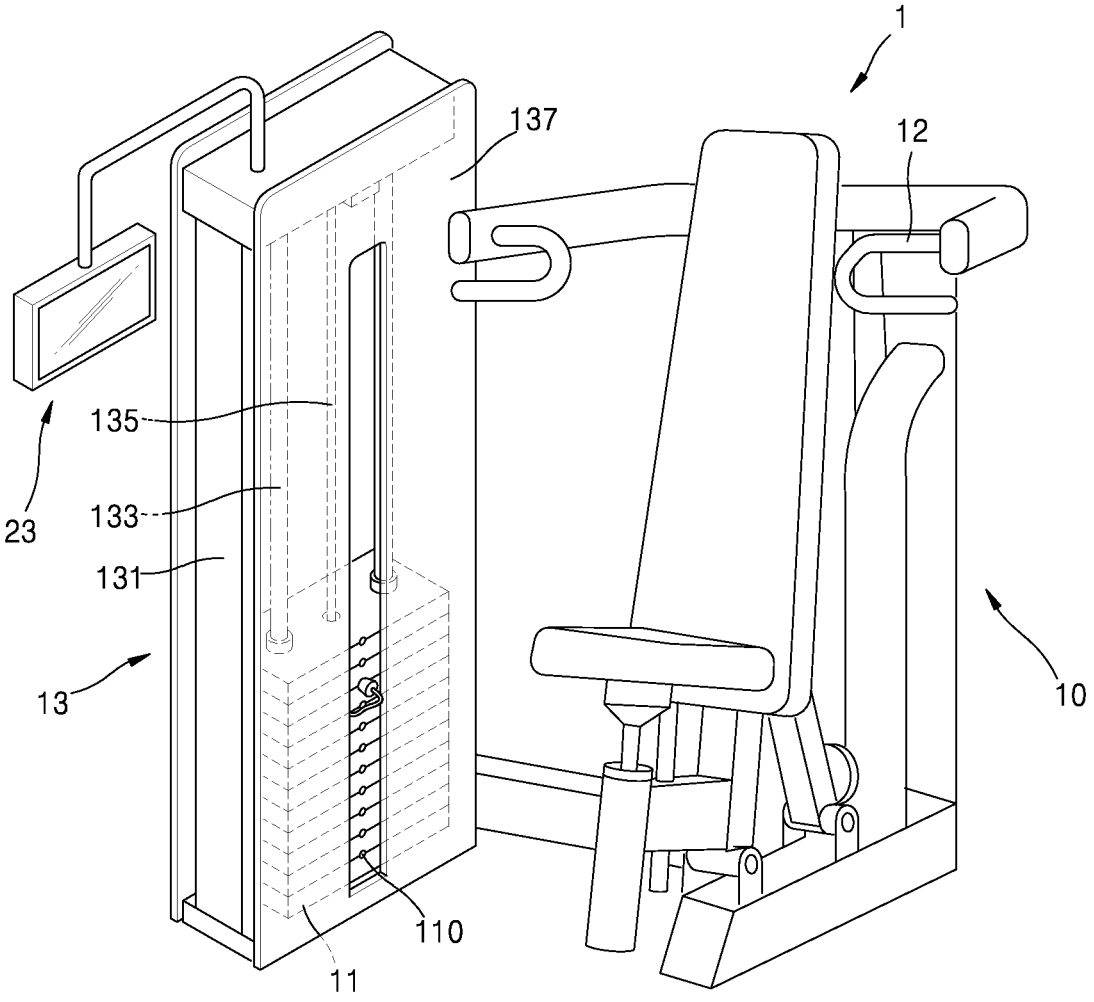
FIGS. 1 and 2 are respectively a perspective view and a block diagram for describing a weight exercise device according to an embodiment.

Embodiments of the present disclosure will now be described more fully with reference to the accompanying drawings. In the drawings, like elements are labeled like reference numerals and the size or thickness of components may be exaggerated for clarity of description.

Figure 2:
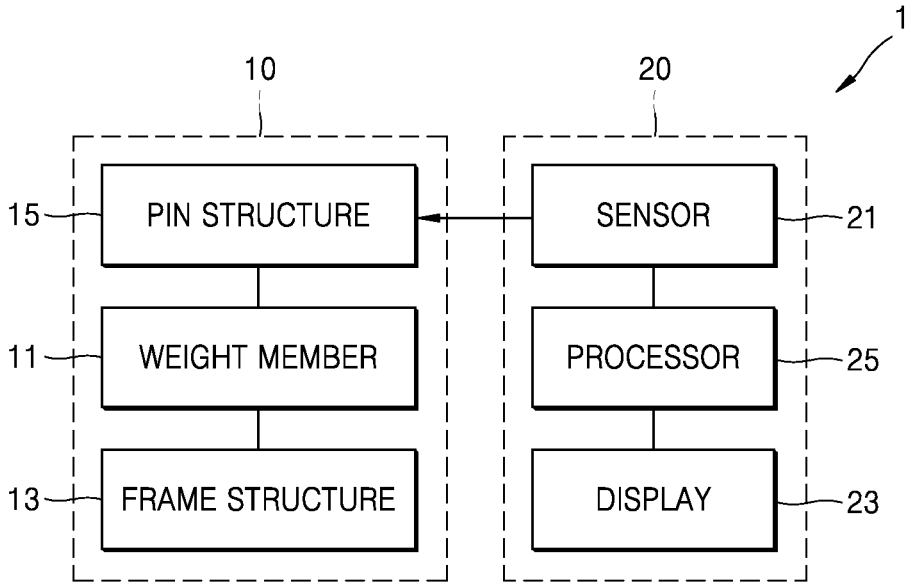
Figure 3:
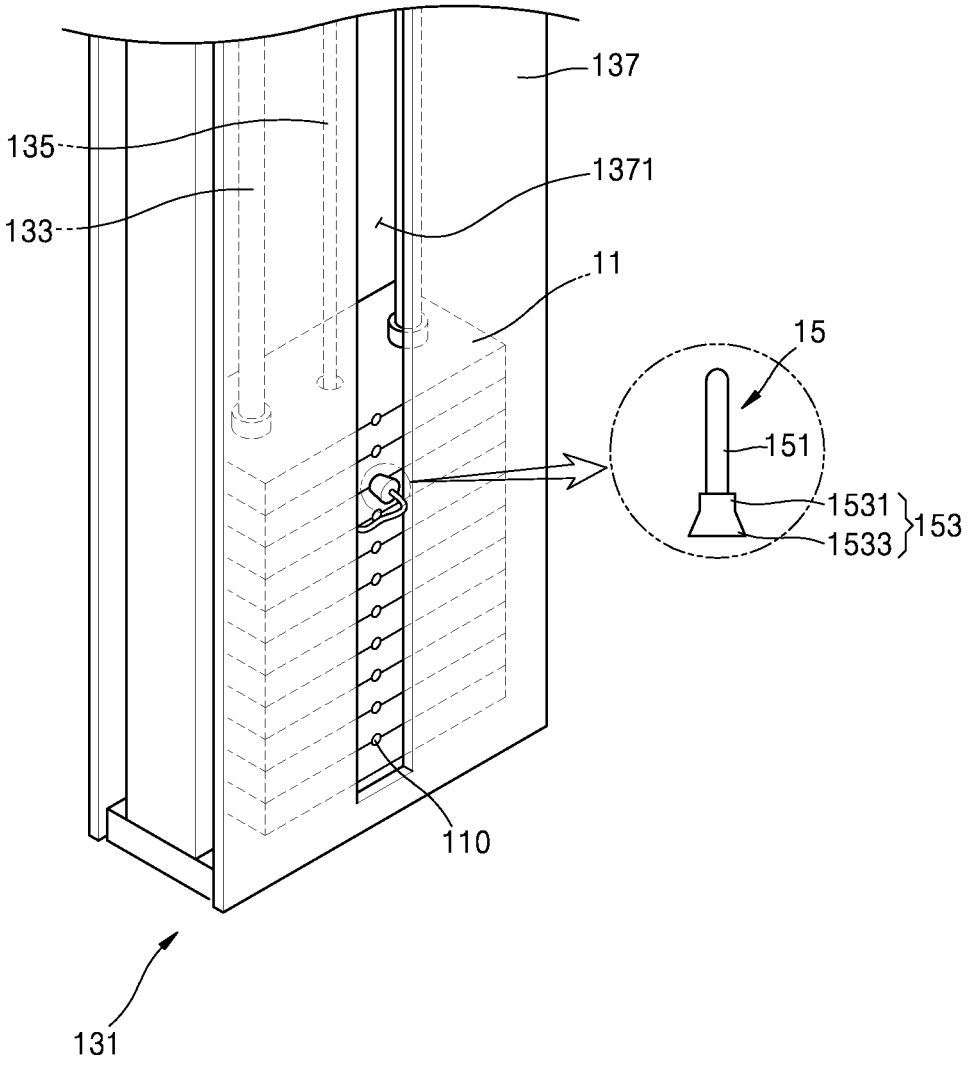
FIG. 3 is a perspective view for describing an exercise body according to an embodiment.

FIGS. 1 and 2 are respectively a perspective view and a block diagram for describing a weight exercise device 1 according to an embodiment. FIG. 3 is a perspective view for describing an exercise body 10 according to an embodiment.

Referring to FIGS. 1 to 3, the weight exercise device 1 may include the exercise body 10, a sensor 21, a display 23, and a processor 25.

The exercise body 10 may include an exercise equipment, a motion of which is generated by weight exercise by a user. For example, the exercise body 10 may include a plurality of weight members 11, a frame structure 13 supporting the plurality of weight members 11 to be movable in the direction of gravity, and a pin structure 15 configured to be inserted into a pin hole 110 so that at least some of the plurality of weight members 11 are selected. However, the configuration of the exercise body 10 is not limited thereto, and may include an exercise equipment used for free weight as needed.

The plurality of weight members 11 may be sequentially stacked along the direction of gravity. The weight members 11 may have a plate shape. However, the shape of the weight members 11 is not limited thereto, and may be in various shapes such as a block shape. Each of the plurality of weight members 11 has a predetermined weight. The pin hole 110 may be formed in each weight member 11 or formed by adjacent weight members 11.

The weights of the weight members 11 may be the same as or different from each other. As an example, each of the plurality of weight members 11 may have the same weight as 5 kg. As another example, some of the plurality of weight members 11 may be 5 kg, and some of the plurality of weight members 11 may be 10 kg. Moreover, the weight of the plurality of weight members 11 may vary.

The frame structure 13 may include a base frame 131 and a pair of guide rails 133 which extend along the direction of gravity such that the plurality of weight members 11 move along the direction of gravity direction, and which are installed on the base frame 131. The pair of guide rails 133 may be arranged to pass through the plurality of weight members 11. The frame structure 13 includes a connection line 135 configured to transmit a force applied by a user, to the weight members 11.

The pin structure 15 includes an insertion area 151 inserted into the pin hole 110 and a holder area 153 fixed to the insertion area 151. The insertion area 151 of the pin structure 15 may have a shape corresponding to the shape of the pin hole 110. In the pin structure 15, the insertion area 151 may have a cylindrical shape, but is not limited thereto, and may have various shapes that may be inserted into the pin hole 110, for example, a plate shape.

As the insertion area 151 of the pin structure 15 is inserted into the pin hole 110 of any weight member 11, the weight of the weight member 11 into which the pin structure 15 is inserted, and the weight of a weight member 11 disposed thereon is selected.

The user applies a force to an exercise structure 12 to move the weight member 11 having the selected weight, in a direction opposite to the direction of gravity or in the direction of gravity. The exercise structure 12 may be implemented in various forms according to a body part to be exercised. The form of the exercise structure 12 is widely known, and thus, a detailed description thereof will be omitted.

In the above-described embodiment, as an example of the exercise body 10, a mechanical weight device that performs weight exercise in the process of physically moving the weight member 11 has been described, but is not limited thereto. For example, although not shown, the exercise body 10 may be an electronic weight device that performs weight exercise by providing a load to a user through a driving motor, without the weight members 11.

The weight exercise device 1 according to an embodiment may include an exercise guide portion 20 that measures an exercise state of the user on the exercise body 10 and provides a user interface screen 230 for improving exercise effects from the exercise body 10.

The exercise guide portion 20 may include the sensor 21 that detects a motion of the exercise body 10, the display 23 that outputs the user interface screen 230, and the processor 25 that controls the display 23.

The sensor 21 may be configured to detect a motion of some components of the exercise body 10, for example, the exercise structure 12. The sensor 21 may be configured to detect a motion of the exercise body 10 in real time. For example, the sensor 21 may be configured to detect, in real time, information related to at least one of a position, a movement velocity, and a movement direction of the weight member 11 selected by the pin structure 15.

Figure 4:
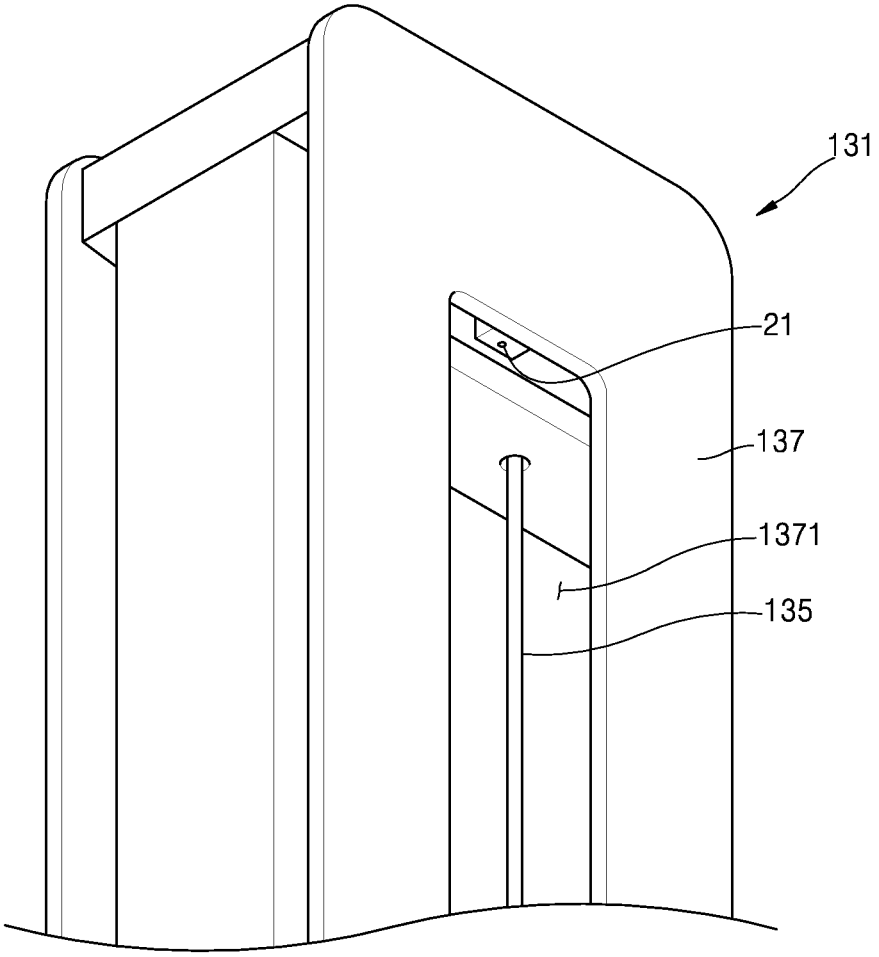
FIGS. 4 and 5 are views taken from different angles to describe an example of a sensor of a weight exercise device according to an embodiment.
Figure 5:
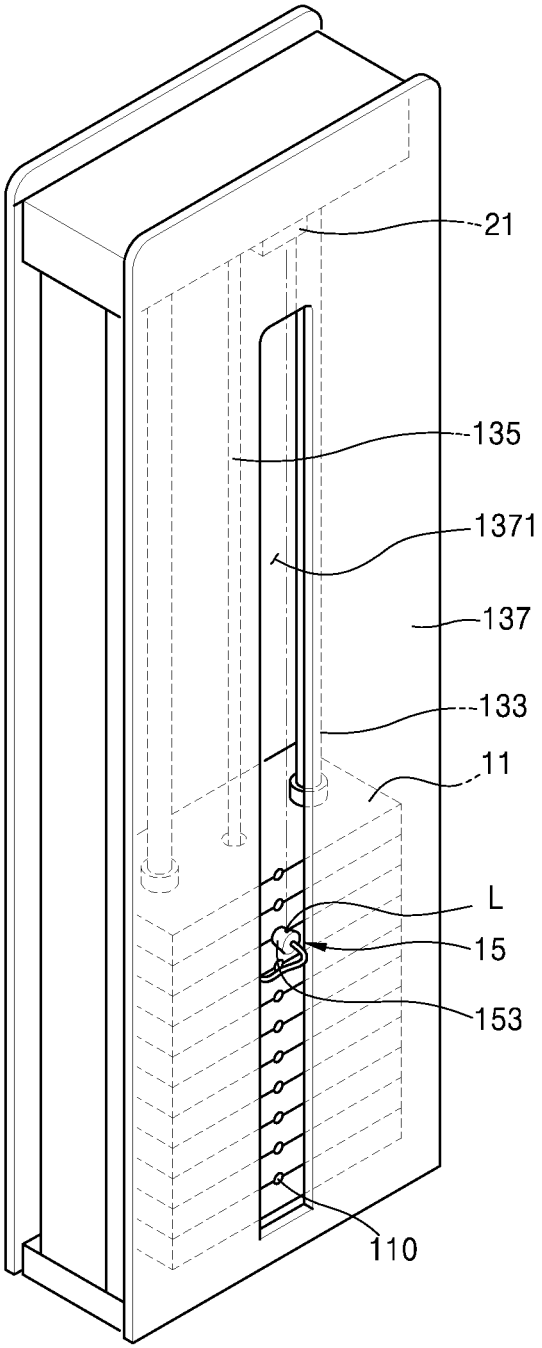
Figure 6:
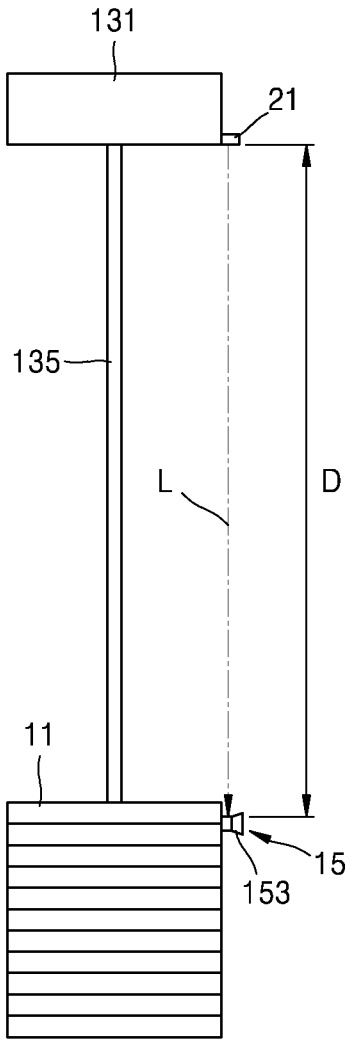
FIG. 6 is a diagram for describing a function of a sensor according to an embodiment.

FIGS. 4 and 5 are views taken from different angles to describe an example of the sensor 21 of the weight exercise device 1 according to an embodiment. FIG. 6 is a diagram for describing a function of the sensor 21 according to an embodiment.

Referring to FIGS. 4 to 6, the sensor 21 may be configured to measure a distance D from the sensor 21 to the pin structure 15 to determine a position of a selected weight member 11.

The sensor 21 may be configured to measure a distance to the holder area 153 of the pin structure 15 inserted into the pin hole 110 of one of the plurality of weight members 11.

When the pin structure 15 is inserted into the pin hole 110 of the weight member 11, the sensor 21 may be disposed at a position overlapping the holder area 153 in the direction of gravity. For example, the sensor 21 may be installed on top of the base frame 131.

The sensor 21 may be disposed so as not to be exposed to a user. For example, the base frame 131 may include a cover 137 disposed on a surface thereof facing a user. The cover 137 may include a guide hole 1371 that allows movement of the pin structure 15. As illustrated in FIG. 4, the sensor 21 may be disposed above the guide hole 1371 and on an inner portion of the cover 137.

The sensor 21 may measure a distance by using a laser beam L. The sensor 21 may be a laser distance meter. The sensor 21 may irradiate the laser beam L to the holder area 153 of the pin structure 15, detect the reflected laser beam L, and measure the distance D to the pin structure 15. As the sensor 21 uses the laser beam L, the structure may be simplified and the cost may be lowered.

When the sensor 21 uses a method other than the laser beam L, a measurement error may be excessively large or the cost may be significantly increased. As an example, when the sensor 21 uses an optical sensing method or an ultrasonic sensing method, accurate distance measurement is impossible due to other components adjacent to the pin structure 15. In addition, as another example, when the sensor 21 uses a magnetic force sensing method, a magnet is to be placed on the pin structure 15 itself, and sensors for detecting a magnetic force are to be placed on a movement path of the pin structure 15. In this case, the cost for distance detection rapidly increases.

However, as the sensor 21 according to an embodiment uses the laser beam L having linearity, interference caused by other components may be excluded, and the cost increase may be minimized due to its simple structure.

The holder area 153 of the pin structure 15 may have a reflective surface that reflects the laser beam L irradiated from the sensor 21.

Referring back to FIG. 3, the holder area 153 may include a cylindrical portion 1531 having a constant diameter along the extension direction of the pin structure 15 and an inclined portion 1533 extending from the cylindrical portion 1531 and having a diameter varying along the extension direction. However, the shape of the holder area 153 is not limited thereto, and may be modified into various shapes within a range where a user inserts the pin structure 15 into the pin hole 110 or removes the same from the pin hole 110.

The sensor 21 may be disposed such that the laser beam L is irradiated to a center of the holder area 153. For example, the center of the sensor 21 may overlap the center of the holder area 153 in the direction of gravity.

The sensor 21 may determine information about a movement velocity and a movement direction of the weight member 11 based on information about a position of the weight member 11. Through this, a motion of the exercise body 10 may be detected.

For example, based on changes in position of the weight member 11 detected at a certain time interval, information about the movement velocity and the movement direction of the weight member 11 may be determined. When the measured distance of the weight member 11 increases, it may be determined that the weight member 11 is lowered, and when the measured distance of the weight member 11 decreases, it may be determined that the weight member 11 is lifted. A movement velocity of the weight member 11 may be determined based on a change in the distance of the weight member 11 measured during a certain unit of time. A detailed description thereof will be omitted since it can be easily implemented by those skilled in the art.

In the above-described embodiment, the movement velocity and the movement direction of the weight member 11 are determined by the sensor 21 based on a movement in the position of the pin structure 15. However, the movement velocity and the movement direction of the weight member 11 are determined not only based on the above. For example, although not shown, the sensor 21 may measure a movement velocity and direction of the connection line 135 connected to the weight member 11, or measure a rotational velocity and direction of a pulley (not shown) that changes a direction of the connection line 135.

Referring back to FIGS. 1 and 2, the display 23 may be physically or electrically connected to the exercise body 10. For example, the display 23 may be installed on the frame structure 13 of the exercise body 10. However, the connection of the display 23 is not limited thereto and may vary. For example, the display 23 may be disposed independently of the exercise body 10. As an example, the display 23 may include a display of a user terminal.

The processor 25 may control, based on the motion of the exercise body 10 detected by the sensor 21, the display 23 to display the user interface screen 230 for improving the user's exercise effect.

FIGS. 7 to 10 are views for describing an example of the user interface screen 230 of the display 23 according to an embodiment.

Figure 7:
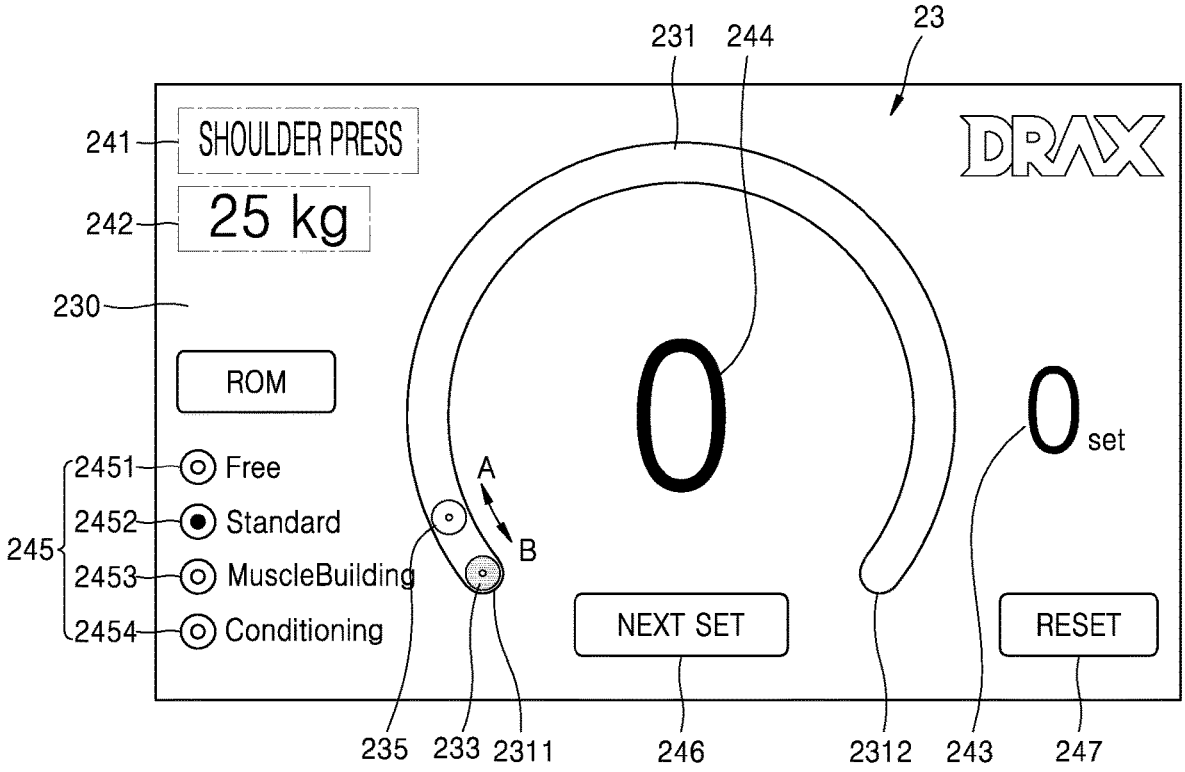
FIGS. 7 to 10 are diagrams for describing an example of a user interface screen according to an embodiment.
Figure 8:
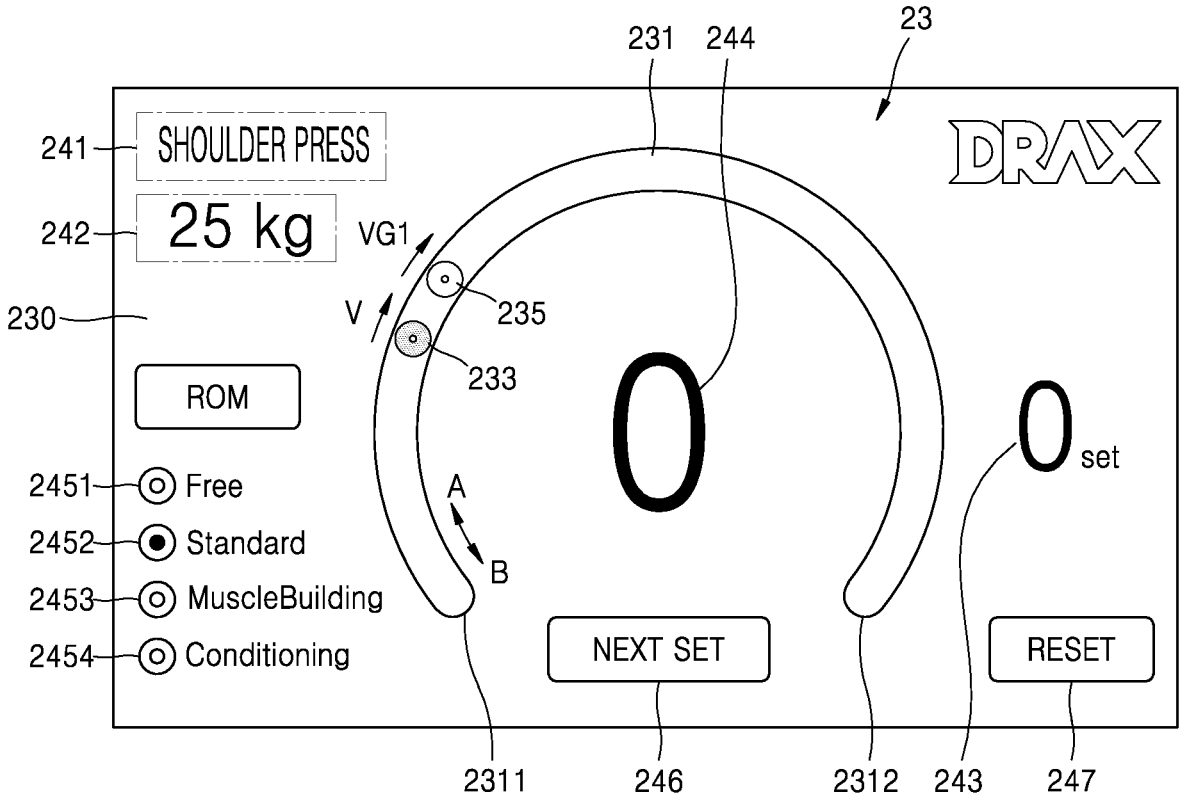

Referring to FIGS. 2, 7, and 8, the display 23 displays the user interface screen 230 that guides a weight exercise of a user.

The processor 25 may control the display 23 to display a first indicator 233 and a second indicator 235 on the user interface screen 230. The first indicator 233 indicates a user's exercise state corresponding to the motion of the exercise body 10 detected by the sensor 21, and the second indicator 235 indicates an exercise guide that is recommended when exercising using the exercise body 10.

The processor 25 may be installed in the exercise body 10, but is not limited thereto. For example, the processor 25 may be disposed in a component other than the exercise body 10, for example, a server located at a remote distance. In this case, the weight exercise device 1 may further include a communication unit (not shown) for signal transmission with the server disposed at a remote distance.

The processor 25 may determine the user's exercise state based on the motion of the exercise body 10 detected by the sensor 21. For example, the processor 25 may determine the user's exercise state based on a distance to the pin structure 15 detected by the sensor 21. The user's exercise state may include information about the user's exercise direction and exercise velocity.

For example, the processor 25 may determine a movement direction and a movement velocity of the pin structure 15 based on a change in a distance value detected at a predetermined time interval. The processor 25 may determine that the pin structure 15 is lowered when the distance to the detected pin structure 15 increases, and determine that the pin structure 15 is lifted when the distance to the detected pin structure 15 decreases. A movement velocity of the pin structure 15 may be determined based on a change in the distance to the pin structure 15 measured during a certain unit of time. The exercise direction and exercise velocity of the user may be determined therefrom.

As the user applies a force to the exercise body 10, the weight member 11 of the exercise body 10 is moved by the pin structure 15 and the connection line 135. A movement direction and a movement velocity of the weight member 11 may be the same as the movement direction and movement velocity of the pin structure 15.

The processor 25 may determine an exercise state of the user based on the determined movement direction and movement velocity of the pin structure 15. For example, the processor 25 may determine the exercise direction of the user to be a first direction when the pin structure 15 is lifted, and may determine the exercise direction of the user to be a second direction when the pin structure 15 is lowered. Also, the processor 25 may determine an exercise velocity of the pin structure 15 as the user's exercise velocity.

The processor 25 controls the display 23 to display the first indicator 233 indicating the user's exercise state on the user interface screen 230. The first indicator 233 indicates the user's exercise state corresponding to the detected motion of the exercise body 10. For example, when the detected movement velocity of the exercise body 10 increases, the processor 25 controls the display 23 to increase the movement velocity of the first indicator 233, and when the movement velocity of the first indicator 233 decreases, the processor 25 controls the display 23 to lower the movement velocity of the first indicator 233. For example, the processor 25 controls the display 23 such that a movement direction of the first indicator 233 is changed when the detected motion direction of the exercise body 10 is changed.

The processor 25 may control the display 23 to reciprocate the first indicator 233 along a reference line 231 on the user interface screen 230. The movement velocity of the first indicator 233 may correspond to the movement velocity of the pin structure 15. For example, the movement velocity of the first indicator 233 may have a certain ratio with respect to the movement velocity of the pin structure 15 or be equal to the movement velocity of the pin structure 15.

The reference line 231 may indicate a range of motion (ROM) of the exercise body 10. For example, one end 2311 of the reference line 231 may correspond to a start position where no external force is applied to the exercise body 10, and the other end 2312 may correspond to a maximum position to which the exercise body 10 may move.

For example, when the user applies a force to the exercise body 10 to lift the selected weight member 11, the first indicator 233 may depart from the one end 2311 of the reference line 231 and move in a first direction A to approach the other end 2312 of the reference line 231, and the velocity thereof may change in proportion to the increasing velocity of the pin structure 15.

Conversely, when the user applies a force to the exercise body 10 to lower the selected weight member 11, the first indicator 233 may move in a second direction B, which is opposite to the first direction A, to be away from the other end 2312 of the reference line 231, and the velocity thereof may change in proportion to the decreasing velocity of the pin structure 15.

The user may recognize his or her own exercise direction and exercise velocity by referring to the movement direction and the movement velocity of the first indicator 233. In addition, the user may recognize his or her position within a certain exercise section by referring to a position of the first indicator 233 on the reference line 231.

The reference line 231 may have a curved shape. For example, the reference line 231 may have a ring shape that is partially cut out.

Figure 11:
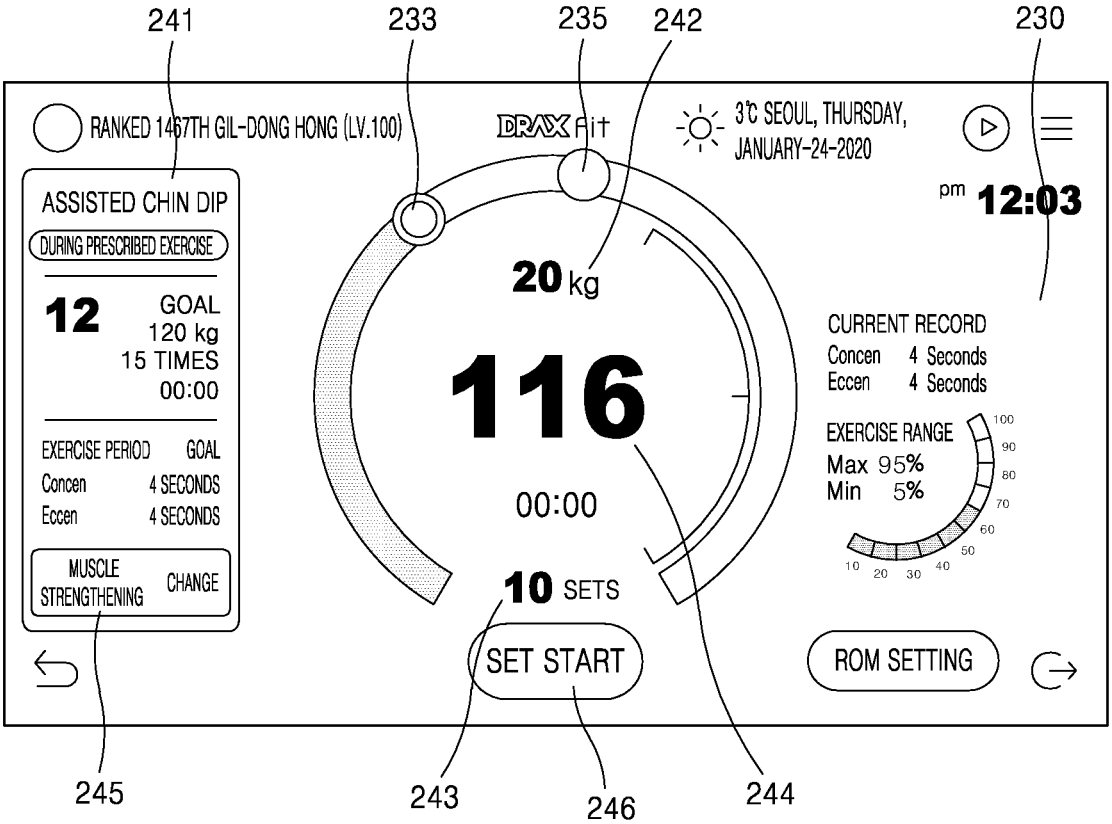
FIG. 11 is a diagram for describing an example of a user interface screen according to another embodiment.

The user interface screen 230 of the display 23 displays various types of information in addition to the exercise direction and exercise velocity of the user, and an input for exercise management may be input to the same. For example, the display 23 may display an exercise name 241, an exercise load 242, an exercise set count 243, and an exercise count 244. For example, the display 23 may display first input portions 2451, 2452, 2453, 2454 for selecting an exercise mode, a second input portion 246 for adjusting an exercise set, and a reset portion 247. However, the user interface screen 230 of the display 23 is not limited thereto and may be variously modified as illustrated in FIG. 11.

Referring back to FIGS. 7 to 10, for efficient exercise of the user, the processor 25 may control the display 23 to display, on the user interface screen 230, the second indicator 235 indicating an exercise guide that is recommended when exercising using the corresponding exercise body 10.

For example, the processor 25 may control the display 23 such that the second indicator 235 moves along the reference line 231 in accordance with a target exercise velocity and a target exercise direction.

The processor 25 may control the display 23 such that the second indicator 235 and the first indicator 233 are simultaneously displayed on the user interface screen 230. Accordingly, while visually checking a difference between the user's current exercise state and a target exercise state, the user may exercise to approach the target exercise state.

The user may compare the second indicator 235 with the first indicator 233 and adjust his or her own exercise velocity. For example, the user may exercise according to the target exercise velocity by increasing the exercise velocity when the first indicator 233 is behind the second indicator 235 and lowering the exercise velocity when the first indicator 233 is ahead of the second indicator 235.

The second indicator 235 may have a same size as the first indicator 233. The second indicator 235 may have a same shape as the first indicator 233 and a different color from the first indicator. However, the sizes, shapes and colors of the second indicator 235 and the first indicator 233 are not limited thereto and may vary.

The display 23 may display the first indicator 233 and the second indicator 235 such that the first indicator 233 and the second indicator 235 reciprocate along the reference line 231. The display 23 only displays a reciprocating exercise direction and velocity of the user through the reference line 231, but does not display the concept of time. Accordingly, even when the user changes the exercise direction at an arbitrary position, the display 23 may easily display the user's target exercise state according to the changed exercise direction.

The processor 25 may control the display 23 to adaptively change a position of the second indicator 235 based on the user's exercise state. The processor 25 may control the display 23 to adaptively change the position of the second indicator 235 based on the movement direction of the first indicator 233.

For example, the position of the second indicator 235 may be dependent on the user's exercise state. The position of the second indicator 235 may be dependent on the movement direction of the first indicator 233.

For example, when it is determined that the exercise direction of the user is changed based on a detected result, the processor 25 may change a direction of the first indicator 233, and control the display 23 such that the second indicator 235 is displayed at a position with the changed direction of the first indicator 233.

For example, when the direction of the first indicator 233 is changed on the user interface screen 230, the processor 25 may control the display 23 such that the second indicator 235 is displayed at the position with the changed direction of the first indicator 233. Accordingly, when the first indicator 233 changes its direction and moves, the second indicator 235 may start moving at the position where the direction of the first indicator 233 is changed. Accordingly, the weight exercise device 1 according to an embodiment may faithfully fulfill an exercise guide for the user even if the user changes the exercise direction at an arbitrary position.

As an example, in the weight exercise device 1 according to an embodiment, the user alternately performs a first exercise of moving the exercise body in a direction of lifting the weight member 11 and a second exercise of moving the exercise body in a direction of lowering the weight member 11. The exercise direction and the exercise velocity are changed while the user alternately performs the first exercise and the second exercise. However, the position or time point at which the exercise direction and the exercise velocity are changed may be different for each user, and even for the same user, they may be different depending on the user's condition. That is, the user may change the exercise direction not at a set position but at any arbitrary position. Accordingly, the direction of the first indicator 233 that moves along the reference line 231 may be changed at an arbitrary position other than both ends 2311 and 2312 of the reference line 231.

Figure 9:
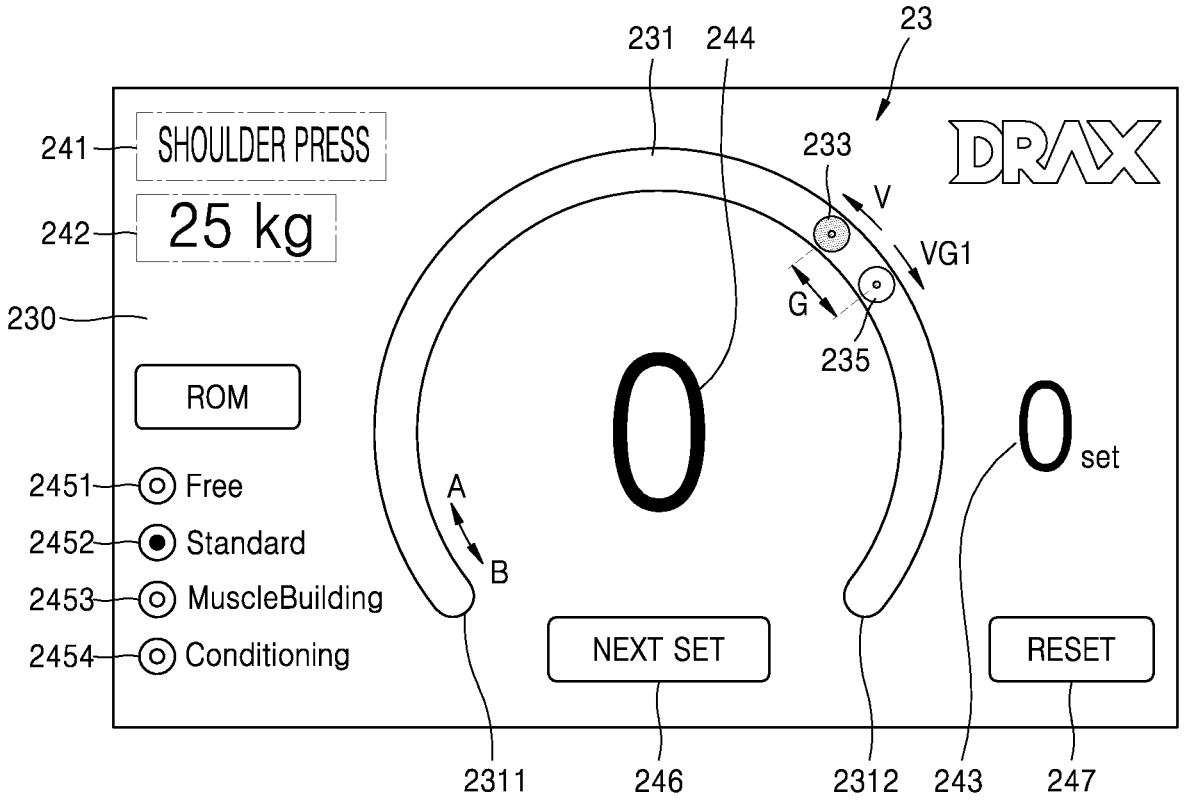

At a moment when the direction of the first indicator 233 is changed, the second indicator 235 may be at the same position as the first indicator 233, but in most cases, as illustrated in FIG. 9, the second indicator 235 may be apart from the first indicator 233 by a certain distance G.

Figure 10:
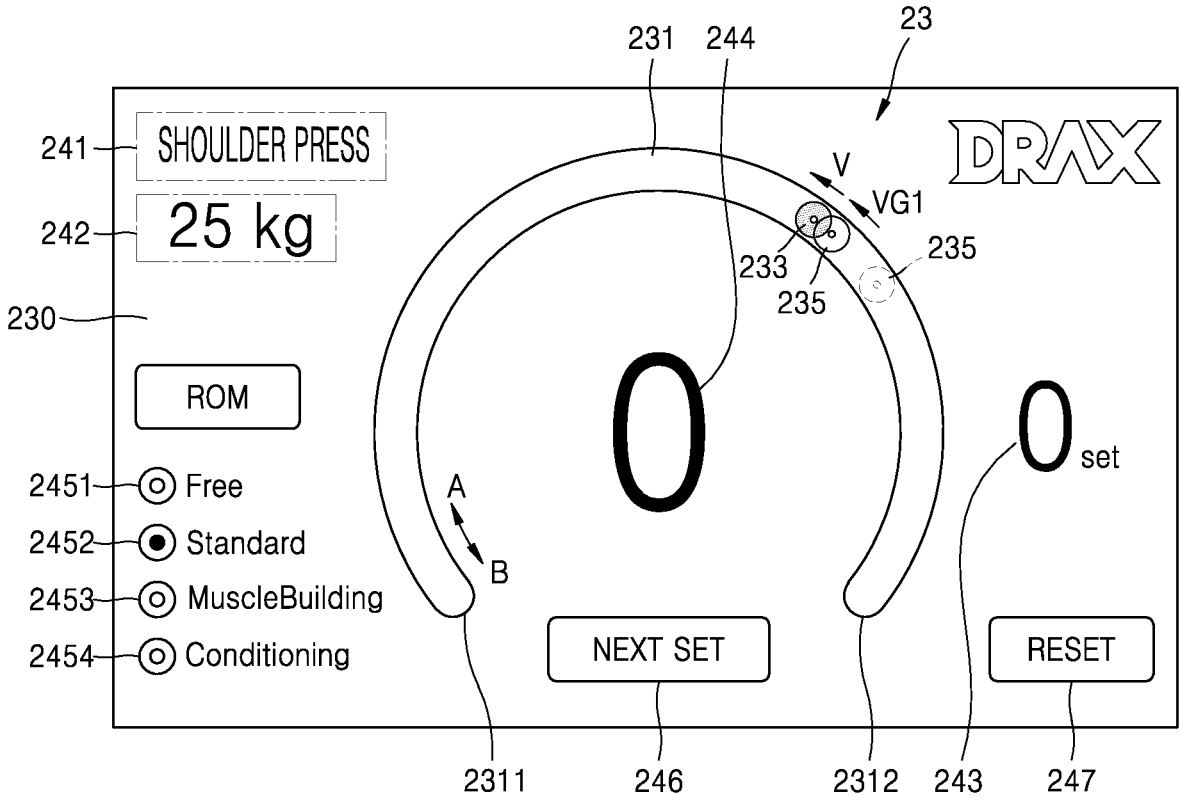

Referring to FIG. 10, the processor 25 may detect a direction change of the pin structure 15 and may detect a position when the direction of the pin structure 15 is changed. Based on a result of detection, the processor 25 may change the direction of the first indicator 233 on the display 23, and instantaneously move the position of the second indicator 235 to a position where the direction of the first indicator 233 is changed. The processor 25 may move the position of the second indicator 235 at the same time when the direction of the first indicator 233 is changed. The processor 25 may move the position of the second indicator 235 within 1 second, for example, within 0.5 second, for example, within 0.1 second from a time point when the direction of the first indicator 233 is changed.

The processor 25 may determine whether a detected motion is a change of the exercise direction, and in the case of a change of the exercise direction, the processor 25 may move the position of the second indicator 235 to the position where the direction of the first indicator 233 is changed.

When the direction of a detected motion is opposite to a previous direction, and a distance moved in the opposite direction or a velocity of the movement in the opposite direction is equal to or greater than a reference value, the processor 25 may determine that the exercise direction of the user is changed. Even when the direction of the detected motion is opposite to the previous direction, when the distance moved in the opposite direction or the velocity of the movement in the opposite direction is less than the reference value, the processor 25 may determine that the exercise direction of the user is not changed.

Figure 12:
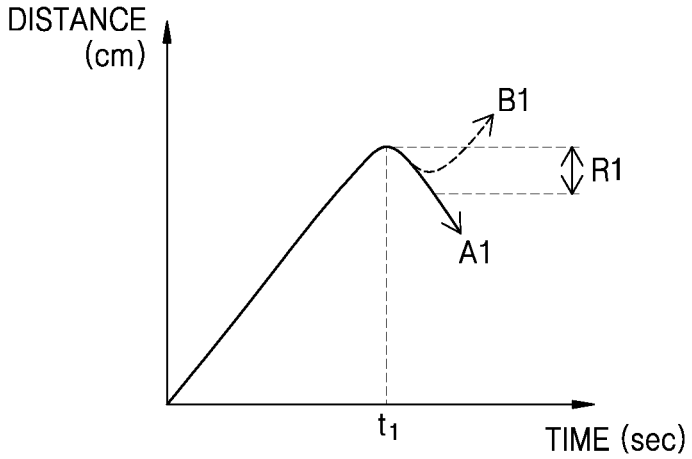
FIG. 12 is a graph showing a movement distance of an exercise body for a certain period of time.
Figure 13:
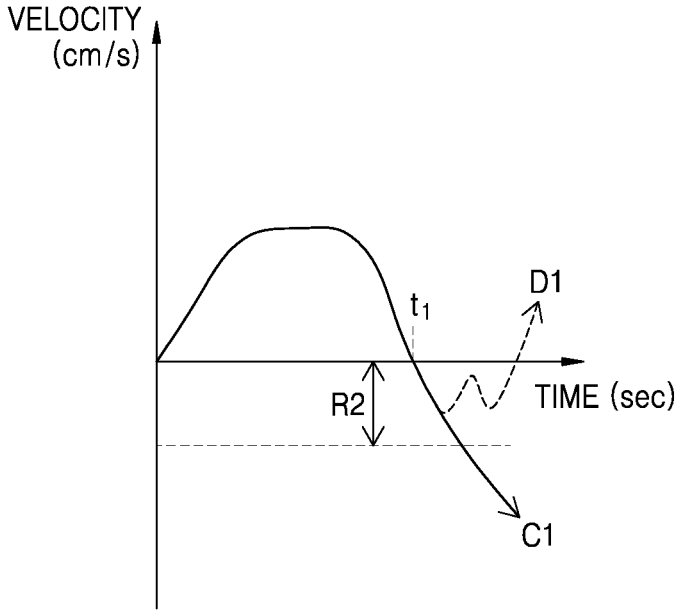
FIG. 13 is a graph showing a movement velocity of an exercise body for a certain period of time.

FIG. 12 is a graph showing a movement distance of the exercise body 10 for a certain period of time, and FIG. 13 is a graph showing a movement velocity of the exercise body 10 for a certain period of time.

Referring to FIG. 12, the movement distance increases as time elapses until a detected motion reaches a certain point in time. Here, it can be seen that the exercise body 10 moves while maintaining its original direction. After a predetermined time point t1, the exercise body 10 may move in a direction opposite to the previous direction. Here, as in A1, when the exercise body 10 moves in the opposite direction to the original direction and the distance moved in the opposite direction is equal to or greater than a first reference value R1, the processor 25 may determine that the exercise direction of the user is changed. Here, as in B1, even when the exercise body 10 moves in the opposite direction to the original direction, when the distance moved in the opposite direction is less than the first reference value R1, the processor 25 may determine that the exercise direction of the user is not changed.

Referring to FIG. 13, a velocity of a detected motion is shown to be greater than 0 until the predetermined point in time t1. In this case, it can be seen that the exercise body 10 moves while maintaining its original direction. After the predetermined time point t1, the movement velocity of the exercise body 10 may be less than 0, which means that the movement direction of the exercise body 10 is opposite to the previous direction. Here, as in C1, when the movement velocity (absolute value) of the exercise body 10 is equal to or greater than a second reference value R2, the processor 25 may determine that the exercise direction of the user is changed. As in D1, when the movement velocity (absolute value) of the exercise body 10 is less than the second reference value R2, the processor 25 may determine that the exercise direction of the user is not changed.

Through this, when a slight, unintentional vibration occurs while the user is exercising, a phenomenon in which the second indicator 235 moves to the position of the first indicator 233 may be prevented.

The reference value may be greater than a movement distance or velocity generated when a minor vibration unintentionally occurs during a user's exercise. For example, the first reference value R1 may be about 0.1 cm to about 15 cm, for example, about 0.2 cm to about 10 cm, for example, about 0.4 cm to about 7 cm. For example, the second reference value R2 may be about 2 cm/s to about 20 cm/s, for example, about 3 cm/s to about 17 cm/s, and about 4 cm/s to about 15 cm/s.

Referring back to FIGS. 9 and 10, when the direction of the first indicator 233 is changed while the second indicator 235 is away from the first indicator 233, the second indicator 235 may move in the same direction as themovement direction of the first indicator 233 at a position where the direction of the first indicator 233 is changed. When the direction of the first indicator 233 is changed, by displaying the second indicator 235 at the position of the first indicator 233 or at a position adjacent thereto, the user's desire to exercise along the second indicator 235 may be stimulated. Here, the adjacent position may refer to a position where a distance between the second indicator 235 and the first indicator 233 is within 5 cm or within 3 cm, even when the second indicator 235 at least partially overlaps or does not overlap the first indicator 233.

When the movement direction of the first indicator 233 is changed, and only the movement direction of the second indicator 235 is changed without a movement in a position thereof, a distance between the second indicator 235 and the first indicator 233 may be maintained at a distance difference between the second indicator 235 and the first indicator 233 before the movement direction is changed or may be greater than a distance difference. This phenomenon may become more severe the more the user changes the exercise direction. This may reduce the user's desire to exercise along the second indicator 235, making it difficult to obtain a desired exercise effect.

On the other hand, in the weight exercise device 1 according to the embodiment, even when the user changes the exercise direction, as the second indicator 235 is displayed at a position close to the position of the first indicator 233, the user's desire to exercise according to the second indicator 235 may be continuously stimulated.

On the other hand, in general, in a mechanical weight exercise machine in which the weight member 11 is physically moved, before the weight of the weight member 11 is set differently, a load that may be applied to the user is preset by the weight of the weight member 11. Accordingly, in the mechanical weight exercise machine, it is difficult to adjust the load applied to the user while the user is exercising.

In the weight exercise device 1 according to the embodiment, in consideration of the limitations of the mechanical weight device, the second indicator 235, which induces a user to exercise with a different load without changing the weight of the weight member 11, may be displayed on the user interface screen 230.

Figure 14:
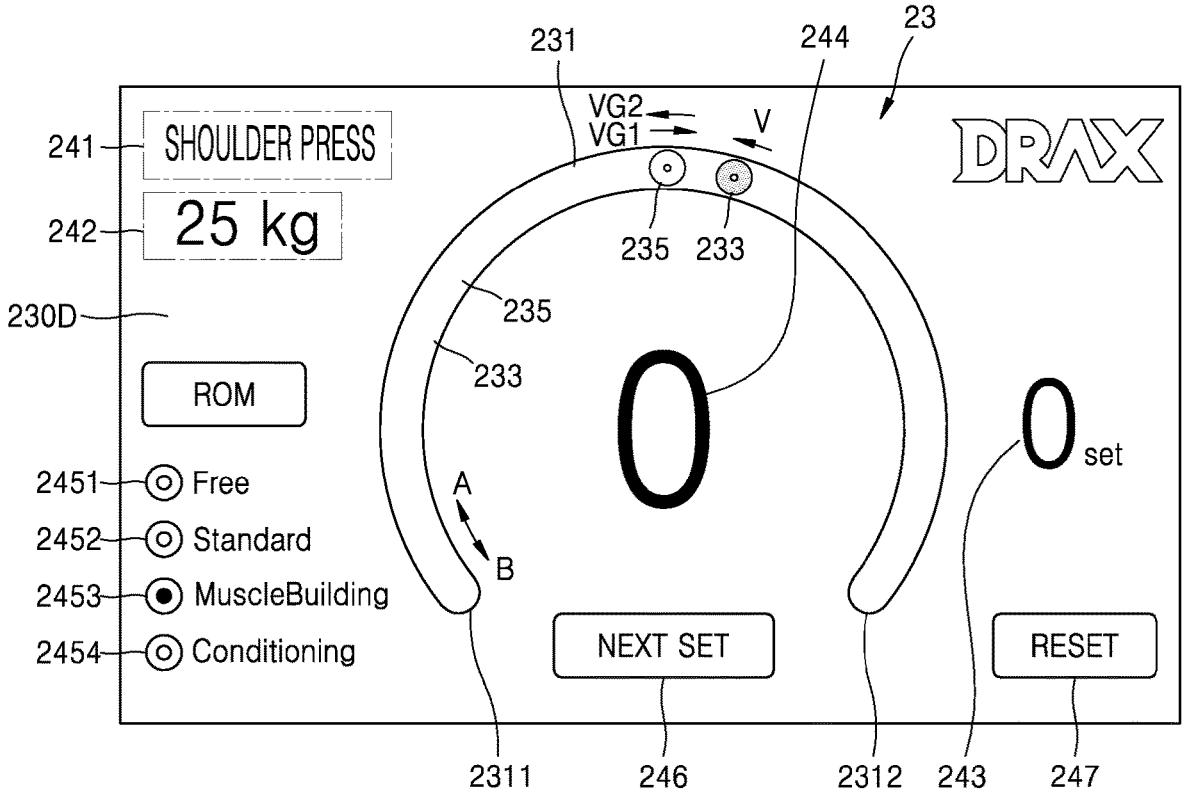
FIG. 14 is a diagram for describing an example of a user interface screen according to another embodiment.

FIG. 14 is a diagram for describing an example of the user interface screen 230 according to another embodiment.

Referring to FIG. 14, the processor 25 may control the display 23 to differently display the velocity of the second indicator 235 on a user interface screen 230D according to the exercise direction of the user. For example, the processor 25 may control the display 23 such that a velocity VG1 of the second indicator 235 in the first direction is different from a velocity VG2 of the second indicator 235 in the second direction. By displaying the velocities VG1 and VG2 of the second indicator 235 differently on the user interface screen 230D, the user may be induced to perform an exercise with a different load applied by the exercise body 10.

In order that the user exercises at different velocities when doing a concentric contraction exercise and when doing an eccentric contraction exercise, the processor 25 may control the display 23 such that the velocities VG1 and VG2 of the second indicator 235 are different from each other according to a direction of the second indicator 235. Here, the concentric contraction exercise may refer to an exercise in which an exercise direction coincides with a muscle contraction direction, and the eccentric contraction exercise may refer to an exercise in which an exercise direction does not coincide with a muscle contraction direction.

During the process of the user's weight exercise, the user may alternately and repeatedly perform the concentric contraction exercise and the eccentric contraction exercise. For example, the first indicator 233 may move in the first direction on the user interface screen 230D while the user performs the concentric contraction exercise, and the first indicator 233 may move in the second direction on the user interface screen 230D while the user performs the eccentric contraction exercise. The processor 25 may control the display 23 such that the velocity of the second indicator 235 in the second direction is slower than the velocity of the second indicator 235 in the first direction. Accordingly, by making the velocity VG2 of the second indicator 235 in the second direction slower than the velocity VG1 thereof in the first direction, when the user performs an eccentric contraction exercise, the user may be induced to exercise such that a greater load is applied to the same muscle. Thus, the user may strengthen the muscles necessary for the eccentric contraction exercise even in a mechanical weight device.

For example, by varying the velocities VG1 and VG2 of the second indicator 235 according to the movement direction of the second indicator 235, the load acting on the user's muscles when the user performs a concentric contraction exercise may be differentiated from the load acting on the muscle of the user when the user performs an eccentric contraction exercise.

In the above-described embodiments, the first indicator 233 and the second indicator 235 have been described based on examples in which the sizes and shapes thereof are the same. However, the sizes and shapes of the first indicator 233 and the second indicator 235 are not limited thereto and may vary.

FIGS. 15 to 21B are views for explaining user interface screens 230A, 230B, 230C, 230E, and 230F according to other embodiments.

Figure 15:
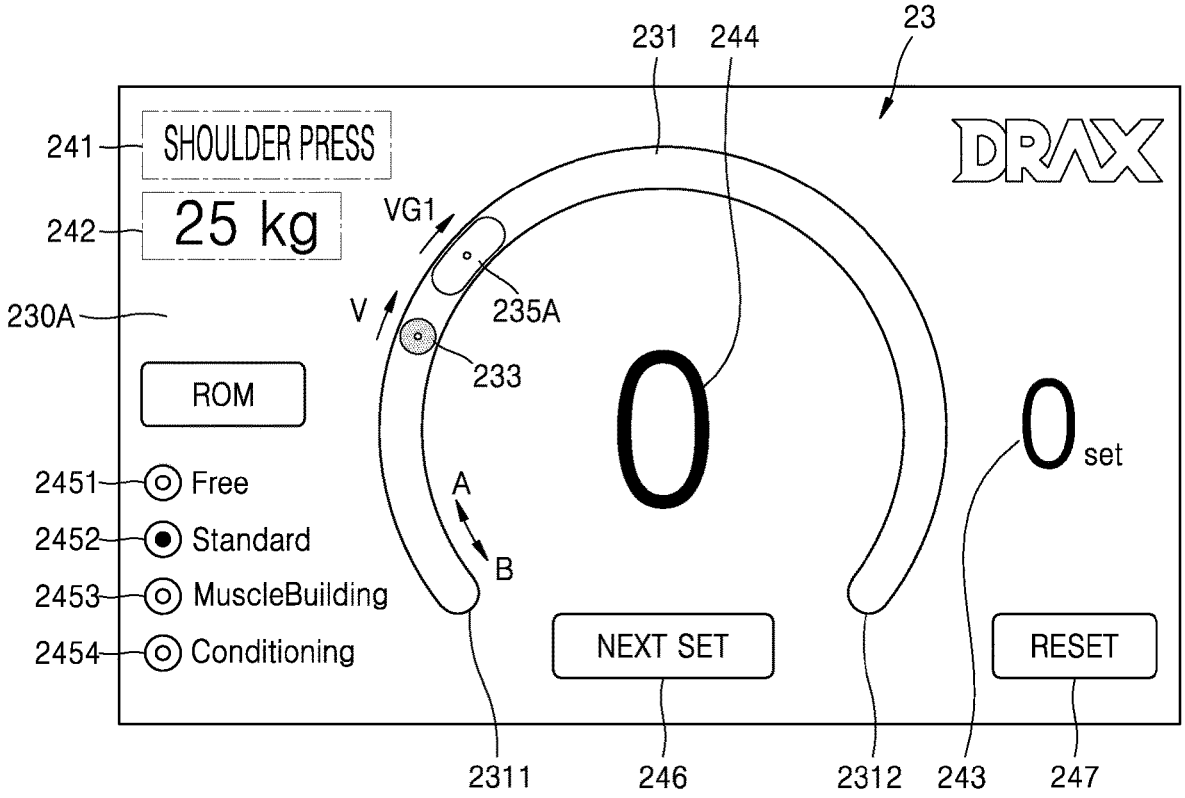
FIGS. 15 to 21B are diagrams for describing an example of a user interface screen according to another embodiment.

Referring to FIG. 15, a second indicator 235A may be larger than the first indicator 233. For example, a length of the second indicator 235A may be longer than that of the first indicator 233. For example, an area of the second indicator 235A may be larger than that of the first indicator 233.

A color of the second indicator 235A may vary according to a distance thereof from the first indicator 233. Here, 'different colors' are defined as indicating that at least one of a color and a pattern is different.

Figure 16:
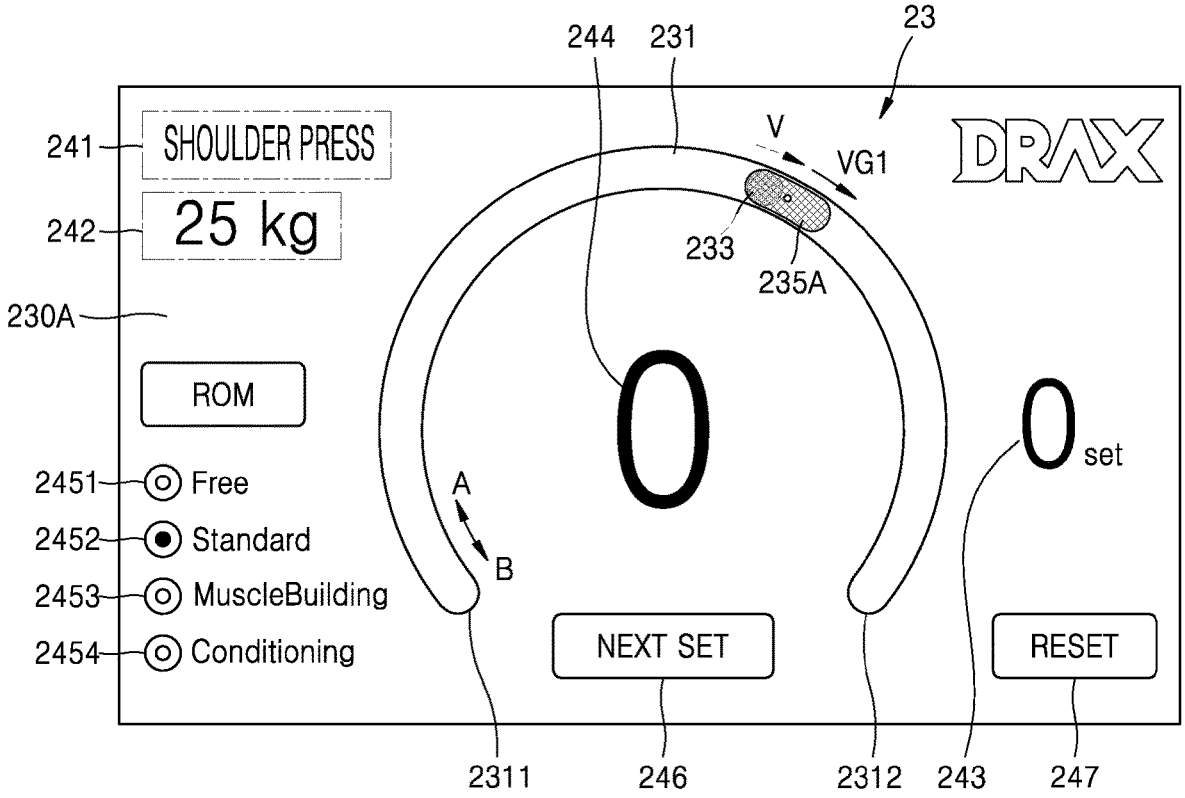

As an example, as illustrated in FIG. 16, when the first indicator 233 overlaps the second indicator 235A, the color of the second indicator 235A may change. As another example, as illustrated in FIG. 17, when the first indicator 233 approaches the second indicator 235A within a predetermined distance D1, the color of the second indicator 235A may change.

For example, the predetermined distance D1 may be equal to or less than twice the length of the first indicator 233. For example, the predetermined distance D1 may be equal to or less than one time the length of the first indicator 233.

In the above-described embodiment, the description is focused on an example in which the color of the second indicator 235A changes according to a distance between the second indicator 235A and the first indicator 233, but is not limited thereto, and the color or shape of the first indicator 233 may change or the shape of the second indicator 235A may change.

Figure 17:
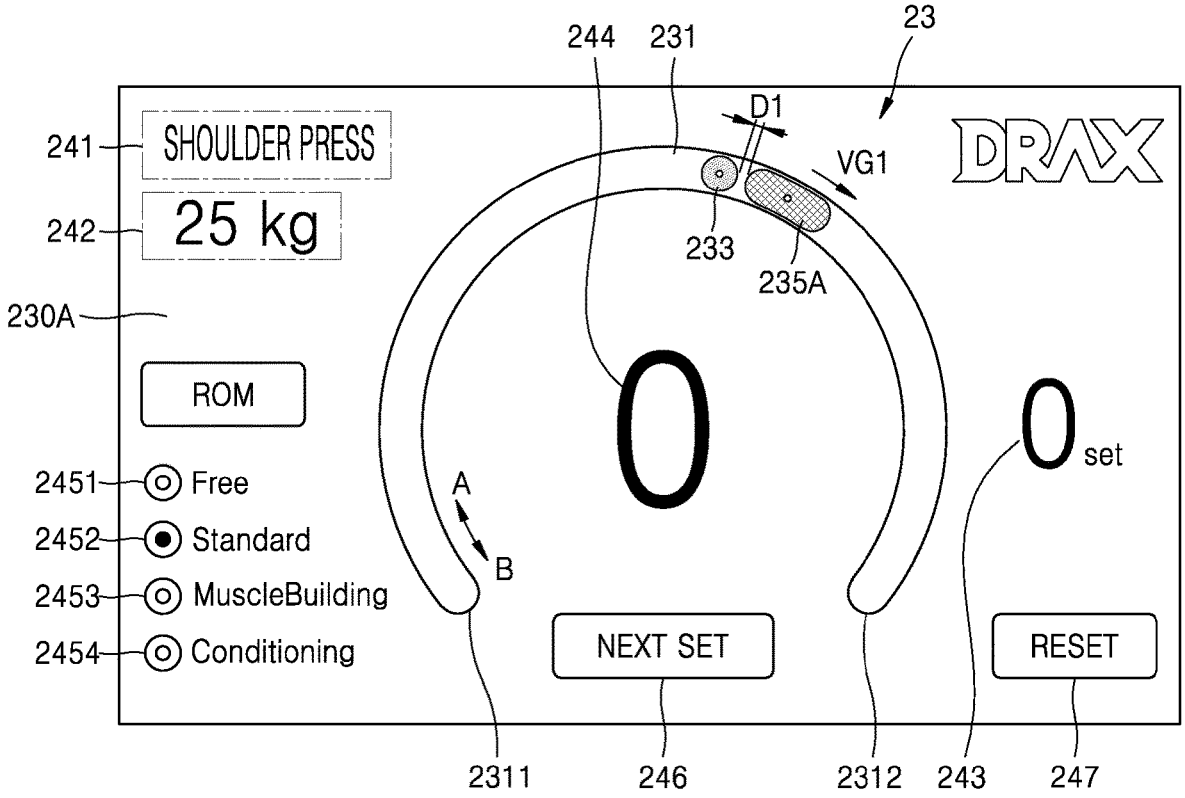
Figure 18:
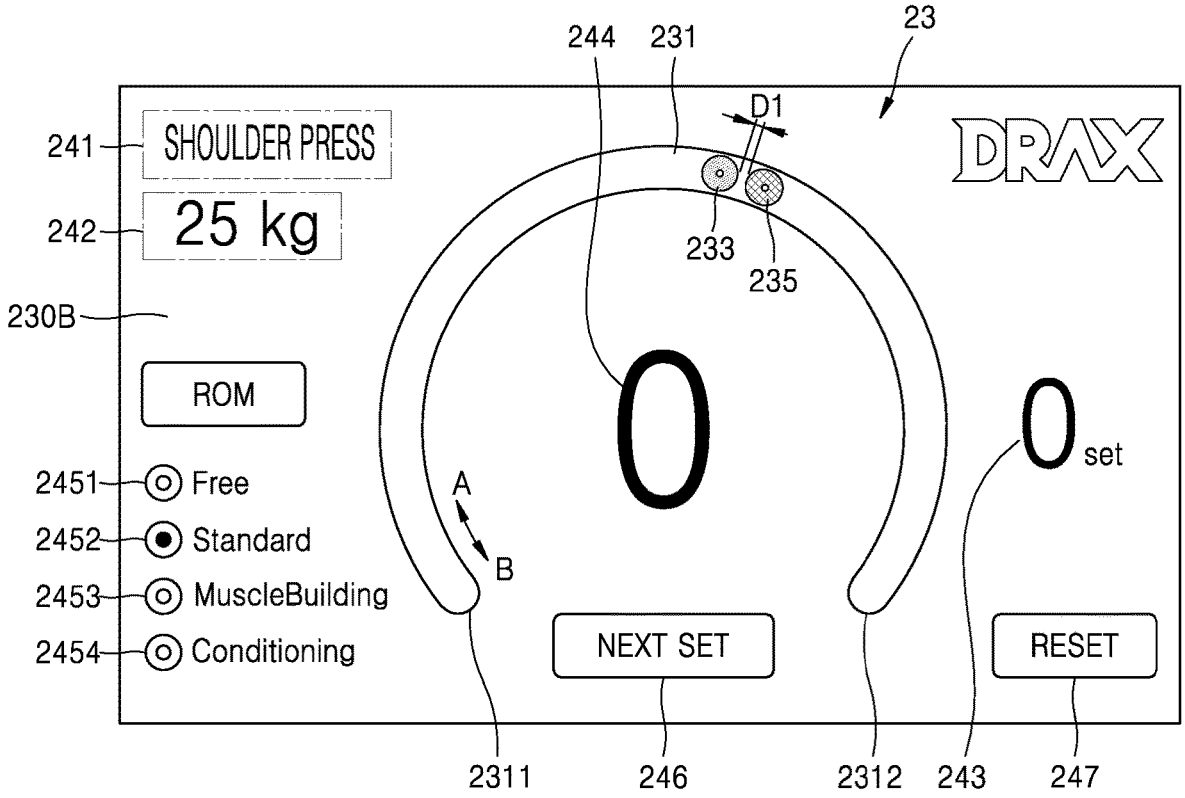

In addition, in the embodiments of FIGS. 15 to 17, description is focused on an example where the second indicator 235A is larger in size than the first indicator 233, but is not limited thereto. For example, as illustrated in FIG. 18, even when the size and shape of the first indicator 233 and the second indicator 235 are the same, according to the distance between the first indicator 233 and the second indicator 235, the color of the second indicator 235 may change.

As described above, as the color or shape of the second indicator 235A or the first indicator 233 changes according to the distance between the second indicator 235A and the first indicator 233, the user's exercise desire may be stimulated.

In the above-described embodiment, the description is focused on an example in which the display 23 displays the second indicator 235 and the first indicator 233 together. However, in the weight exercise device 1 according to the embodiment, the first indicator 233 does not need to be displayed together with the second indicator 235, and the first indicator 233 may be displayed without the second indicator 235 according to the selection by the user.

The processor 25 may provide various modes for user selection, through the display 23. For example, a plurality of modes may be displayed to the user through the display 23 and at least one of the plurality of modes may be selected.

For example, the display 23 may display the second indicator 235 differently according to an exercise mode selected by the user. For example, depending on whether the display 23 is in a first mode 2451, a second mode 2452, a third mode 2453 or a fourth mode 2454, the display 23 may display the second indicator 235 differently on the user interface screens 230C, 230B, and 230D. However, the number of modes in the display 23 is not limited thereto and may vary.

Figure 19:
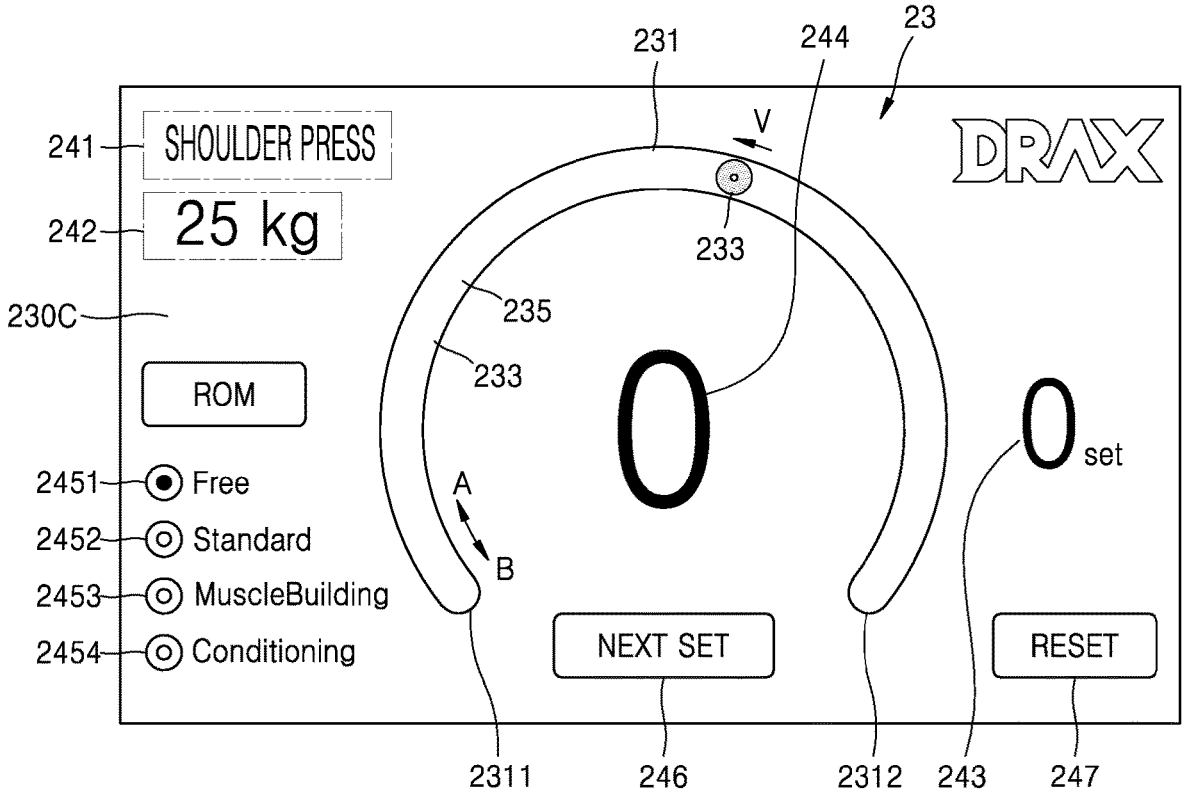

In the first mode 2451, as illustrated in FIG. 19, only the first indicator 233 indicating the user's current exercise state may be displayed, and the second indicator 235 may not be displayed, in order that the user may exercise according to his or her free will.

In the second mode 2452, the third mode 2453, and the fourth mode 2454, the second indicator 235 may be displayed together with the first indicator 233 to guide the user's exercise.

In the second mode 2452, the second indicator 235 may reciprocate along the reference line 231 at the same movement velocity VG1 in the first direction A and the second direction B, thereby guiding the user to exercise at a constant velocity.

In the third mode 2453 and the fourth mode 2454, the second indicator 235 may display the movement velocity thereof differently according to the movement direction. For example, when the second indicator 235 moves along the reference line 231 in the first direction A, the velocities VG1 and VG3 of the second indicator 235 may be higher than the velocities VG2 and VG4 thereof when moving in the second direction B.

For example, referring to FIG. 14, in the third mode 2453, when the user does a concentric contraction exercise, the second indicator 235 moves at a first velocity VG1, and the user changes the exercise direction and does an eccentric contraction exercise, the second indicator 235 may move at a second velocity VG2 slower than the first velocity VG1. For example, the second velocity VG2 may be less than ⅔ of the first velocity VG1. The second velocity VG2 may be less than ½ of the first velocity VG1. Through this, a user's exercise may be guided so that the user may obtain an effect such as muscle strengthening.

Figure 20:
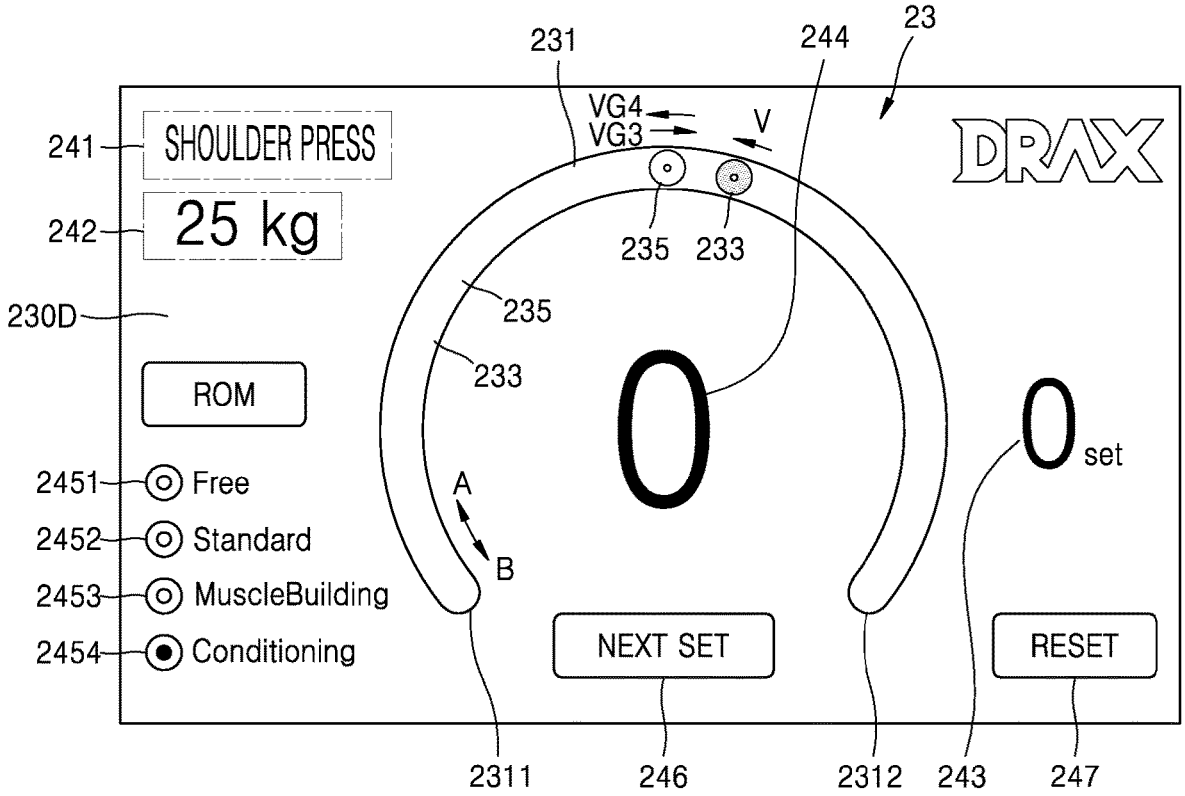
Figure 21A:
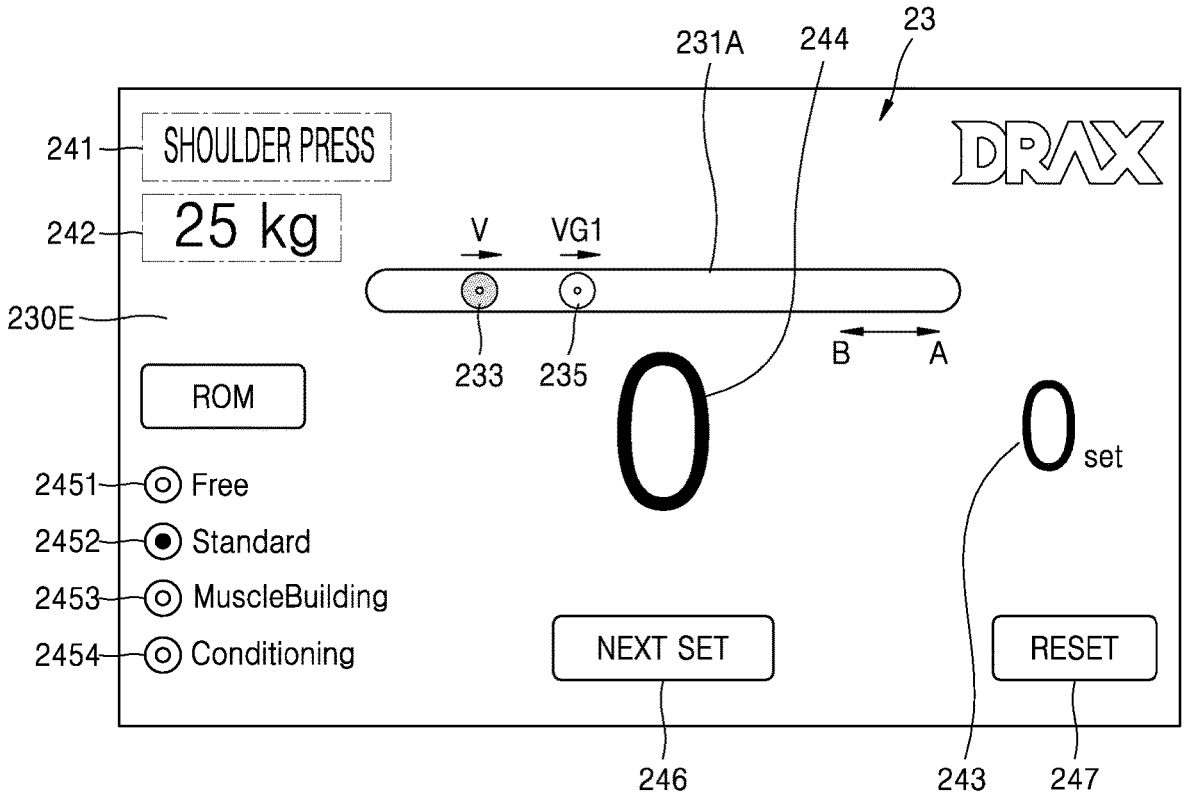
Figure 21B:
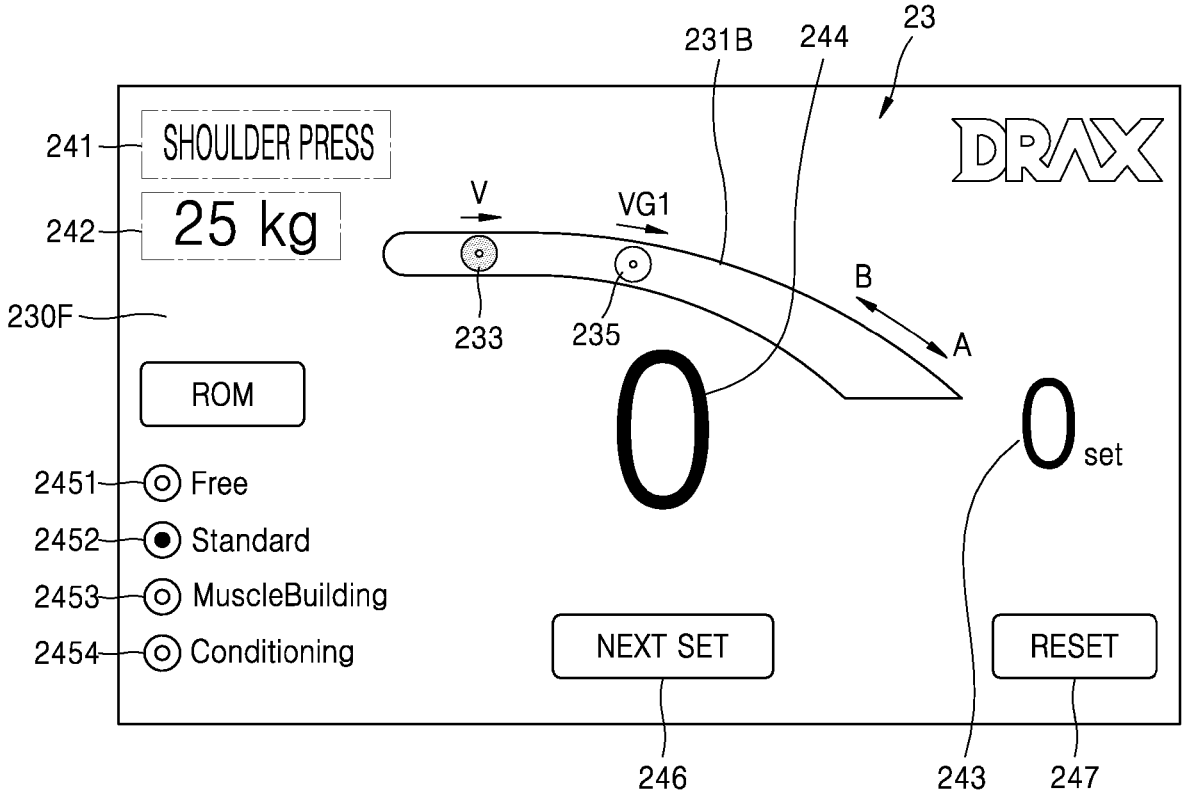

For example, referring to FIG. 20, in the fourth mode 2454, when the user does a concentric contraction exercise, the second indicator 235 may move at a third velocity VG3, and the user changes the exercise direction and does an eccentric contraction exercise, the second indicator 235 may move at a fourth velocity VG4 slower than the third velocity VG3. The fourth velocity VG4 may be less than ⅔ of the third velocity VG3. The fourth velocity VG4 may be less than ½ of the third velocity VG3. For example, the third velocity VG3 may be higher than the first velocity VG1. The third velocity VG3 may be about 1.3 times to about 2 times the first velocity VG1. Through this, it is possible to guide the user's exercise so that the user may obtain an effect such as physical condition recovery.

In the above-described embodiment, description is focused on an example in which the reference line 231 displayed on the user interface screens 230, 230A, 230B, 230C, and 230D of the display 23 is curved. However, the shape of the reference line 231 is not limited thereto, and may be modified in various forms as long as it is in a form guiding a reciprocating motion. For example, reference lines 231A and 231B of the user interface screens 230E and 230F may have a bar shape as in FIG. 21A or a shape in which at least a partial section is curved as in FIG. 21B.

While a shoulder press for strengthening the shoulders is presented as an example of the exercise body 10 in the above-described embodiments, the disclosure is not limited thereto, and may be applied to any exercise device for weight exercise in various manners.

The embodiments according to the present disclosure may be embodied as computer programs executable by various components on a computer, and may be recorded on a computer-readable recording medium. Examples of the computer-readable recording medium may include magnetic media (e.g., hard disks, floppy disks, magnetic tapes, etc.), optical media (e.g., CD-ROMs, or DVDs), magneto-optical media (e.g., floptical disks), and hardware devices specifically configured to store and execute program instructions (e.g., ROM, RAM, flash memories, etc.) Furthermore, the medium may include an intangible medium implemented in a form transmittable on a network, and may be, for example, a medium implemented in the form of software or an application to be transmitted and distributed through a network.

The program programs may be specifically designed and configured for the present disclosure or may be well-known and available to one of ordinary skill in the art in the software field. Examples of the computer program may include not only machine codes generated by using a compiler but also advanced language codes that can be executed on a computer by using an interpreter or the like While the present disclosure has been particularly shown and described with reference to embodiments thereof, it will be understood by those of ordinary skill in the art that various changes in form and details may be made therein without departing from the spirit and scope of the present disclosure as defined by the appended claims. The disclosed embodiments should be considered in a descriptive sense only and not for purposes of limitation. Therefore, the scope of the present disclosure is defined not by the detailed description of the present disclosure but by the appended claims, and all differences within the scope will be construed as being included in the present disclosure.

The invention claimed is:

1. A weight exercise device comprising:

an exercise body using which a motion is generated according to a weight exercise of a user;

a sensor configured to detect the motion of the exercise body;

a display configured to output a user interface screen; and a processor, operatively connected to the sensor and the display, configured to control the display to display, on the user interface screen, a first indicator movable along a reference line based on the detected motion, the first indicator indicating an exercise state of the user, and a second indicator movable along the reference line indicating an exercise guide that is recommended when exercising using the exercise body, wherein the processor is further configured to:

determine an exercise direction based on a first detected motion; determine that the exercise direction is changed based on a second detected motion, wherein the change in the exercise direction includes a change in the exercise direction at any arbitrary position; and in response to the determined change in the exercise direction, control the display to move a position of the second indicator on the reference line to a position of the first indicator on the reference line corresponding to where the exercise direction is changed.

2. The weight exercise device of claim 1, wherein the processor is further configured to control the display such that the first indicator and the second indicator reciprocate along the reference line on the user interface screen, in a first direction and a second direction opposite to the first direction.

3. The weight exercise device of claim 2, wherein the processor is further configured to control the display such that a velocity of the second indicator in the first direction is different from a velocity of the second indicator in the second direction.

4. The weight exercise device of claim 3, wherein the processor is further configured to control the display such that, in order for the user to exercise at different velocities when doing a concentric contraction exercise and when doing an eccentric contraction exercise, the velocity of the second indicator is varied according to a direction of the second indicator.

5. The weight exercise device of claim 2, wherein the display displays the reference line in a curved form.

6. The weight exercise device of claim 1, wherein the exercise body comprises a plurality of weight members, a frame structure supporting the plurality of weight members to be movable in a direction of gravity, and a pin structure configured to select at least some of the plurality of weight members, and the detected motion of the exercise body comprises at least one of: i) a position of at least one of the plurality of weight members selected by the pin structure, and ii) a movement velocity and a movement direction of the at least one of the plurality of weight members.

7. The weight exercise device of claim 6, wherein the sensor is installed on the frame structure, and is further configured to irradiate a laser beam to the pin structure, receive a reflected laser beam from the pin structure, and measure a distance from sensor to the pin structure based on the received reflected laser beam.

8. The weight exercise device of claim 1, wherein the processor is configured to determine that the exercise direction is changed based on the second detected motion by at least one of:

determining that a distance by which the exercise body moves in a second direction corresponding to the second detected motion that is opposite to a first direction corresponding to the first detected motion is greater than or equal to a first reference value; and determining that a velocity with which the exercise body moves corresponding to the second detected motion is greater than or equal to a second reference value.

9. A weight exercise device comprising:

an exercise body using which a motion is generated according to a weight exercise of a user;

a sensor configured to detect the motion of the exercise body;

a display configured to output a user interface screen; and a processor, operatively connected to the sensor and the display, configured to control the display such that a first indicator and a second indicator reciprocate along a reference line on the user interface screen, in a first direction and a second direction opposite to the first direction, wherein the first indicator indicates an exercise state of the user and reciprocates along the reference line based on the detected motion, and the second indicator indicates an exercise guide that is recommended when exercising using the exercise body, wherein the processor is further configured to:

determine an exercise direction based on a first detected motion;

determine that the exercise direction is changed based on a second detected motion, wherein the change in the exercise direction includes a change in the exercise direction at any arbitrary position; and in response to the determined change in the exercise direction:

i) control the display to move a position of the second indicator on the reference line to a position of the first indicator on the reference line corresponding to where the exercise direction is determined to be changed based on the second detected motion; and ii) control the display such that a velocity of the second indicator in the first direction is different from a velocity of the second indicator in the second direction.

* * * * *